US006927557B2

(12) United States Patent
Pröll et al.

(10) Patent No.: US 6,927,557 B2
(45) Date of Patent: Aug. 9, 2005

(54) VOLTAGE GENERATOR ARRANGEMENT

(75) Inventors: Manfred Pröll, Dorfen (DE); Stephan Schröder, München (DE); Joerg Vollrath, Olching (DE); Ralf Schneider, München (DE)

(73) Assignee: Infineon Technologies AG (DE)

( * ) Notice: Subject to any disclaimer, the term of this patent is extended or adjusted under 35 U.S.C. 154(b) by 0 days.

(21) Appl. No.: 10/736,507

(22) Filed: Dec. 17, 2003

(65) Prior Publication Data

US 2004/0130310 A1 Jul. 8, 2004

(30) Foreign Application Priority Data

Dec. 17, 2002 (DE) ..... 102 59 055

(51) Int. Cl.[7] ..... G05F 3/04
(52) U.S. Cl. ..... 323/312; 327/539
(58) Field of Search ..... 323/312, 313, 323/314; 327/539, 538, 530

(56) References Cited

U.S. PATENT DOCUMENTS 4,524,318 A * 6/1985 Bumham et al. ..... 323/313
5,471,131 A * 11/1995 King et al. ..... 323/314

* cited by examiner

*Primary Examiner*—Shawn Riley
(74) *Attorney, Agent, or Firm*—Edell, Shapiro & Finnan, LLC

(57) ABSTRACT

A voltage generator arrangement supplies a largely constant output voltage with a high current driver capability. A bandgap reference circuit drives a voltage generator on the output side, if necessary via an impedance converter. The bandgap reference circuit and the impedance converter on the one hand, and the voltage generator on the other hand, are connected to different reference ground potential lines. The voltage generator on the output side is preceded by a correction circuit, which corrects for the voltage drop on that reference ground potential line to which the output-side voltage generator is connected. The voltage generator arrangement is suitable for a greater integration density.

11 Claims, 2 Drawing Sheets

VOLTAGE GENERATOR ARRANGEMENT

CROSS-REFERENCE TO RELATED APPLICATION

This application claims priority under 35 USC §119 to German Application No. 10259055.9, filed on Dec. 17, 2002, and titled "Voltage Generator Arrangement," the entire contents of which are hereby incorporated by reference.

FIELD OF THE INVENTION

The invention relates to a voltage generator arrangement, and more particularly, to a voltage generator arrangement for integration in a semiconductor chip that produces a constant output voltage for driving and supplying functional units.

BACKGROUND

A large number of internal voltages of different magnitude are required in integrated semiconductor circuits, for example, in dynamic semiconductor memory modules DRAM, in order to supply internal functional units and to operate them correctly. The output voltage is as constant as possible and is provided with adequate current driver capability, with as low an impedance as possible.

As is known, a DRAM includes memory cells with a storage capacitor, whose state of charge represents the stored information. Due to leakage currents, the stored state of charge in the capacitor is changed, and the separation from a reference decreases. In order to make it possible to read the stored information without errors in spite of this, it is necessary for the reference levels used to be as constant as possible and to maintain a predetermined level of magnitude, even in poor operating states. For example, a voltage generator, which is located centrally between the voltage levels that represent the two binary logic states, is required. Since the information to be read is compared with this central voltage level, its accuracy is subject to relatively stringent requirements. Finally, further potentials which supply the memory cell array and the circuits for reading and writing are also provided by a higher-level voltage generator arrangement.

Such a voltage generator arrangement includes two or more stages. A bandgap reference circuit provides an output potential, which is referred to as reference ground potential, and is largely independent of external operating influences, such as the external supply voltage or temperature. The bandgap reference circuit has a high-impedance output. The bandgap reference circuit is thus expediently followed on the output side by an impedance converter, which transforms the reference potential, that is provided with a high impedance, to a low impedance. Finally, the impedance converter drives a voltage generator, which is arranged on the output side and supplies an output potential that is as constant as possible and has a high current driver capability, and whose magnitude is set as a function of the output signal from the impedance converter. Two or more impedance converters may be driven in parallel by the same bandgap reference circuit, or various output-side voltage generators may be provided in order to produce different output voltages, or the same voltages which can be fed in at different points on the semiconductor chip.

For such a voltage generator arrangement separate reference ground potential lines have been provided. The bandgap reference circuit and the impedance converter are connected to a first reference ground potential line. The bandgap reference circuit and the impedance converter draw a constant current irrespective of the various operating states of the DRAM. Furthermore, the current that is drawn is relatively small. The voltage drop along this line is thus constant, or can easily be compensated for. The output-side voltage generator is connected to a second reference ground potential line, which is separate from the first. The two reference ground potential lines are, for example, formed from metal tracks, which run in a metallization plane on the semiconductor chip and which, for example, are composed of aluminum or of an aluminum alloy. The reference ground potential is supplied from the exterior via what is referred to as a connecting pad.

Various pads are also feasible, which are then connected to one another externally to the chip. The two reference ground potential lines which have been mentioned are typically connected via the connecting pad at least to the external supply for the reference ground potential.

Since the current, which is not inconsiderable during operation, is supplied via the external voltage generator to a load that is to be driven, and this current flows back via the second reference ground potential line to the connecting pad, in which case the current that is drawn can also fluctuate relatively severely as a function of the operating states of the DRAM, the voltage drop along the second reference ground potential line is no longer negligible. A voltage drop is thus produced between the connecting pad and that point at which the output-side voltage generator makes contact with the second reference ground potential line. This voltage drop can fluctuate over time.

The described voltage generator arrangement is subject to the problem that the reference generator and the impedance converter are always supplied with a constant reference ground potential, while the potential at the reference ground potential connection for the output-side voltage generator fluctuates as a function of the current flowing via the second reference ground potential line. Thus, during operation, the reference ground potentials for the output-side voltage generator on the one hand and for the bandgap reference circuit and impedance converter on the other hand differ from one another.

In particular, as the miniaturization of the structures on the integrated semiconductor chip progresses and as the complexity of the circuits to be supplied increases, there is a trend on the one hand to reduce the internal voltages further although, on the other hand, higher currents are required, even though the resistances of the metallization lines increase. As a consequence of these boundary conditions, it is problematic to provide the required internal voltages with sufficient constancy and a sufficiently high current drive capability with the use of conventional concepts.

SUMMARY

A voltage generator arrangement can produce a sufficiently stable output voltage for a functional unit that is to be supplied, in the boundary conditions mentioned above. In particular, the voltage generator can provide an output voltage that is as stable as possible, even in large-scale integrated circuits with relatively small structure widths.

A voltage generator arrangement includes a connection for a supply potential, a connection for a reference ground potential, an output connection for an output potential to be tapped off, a first reference ground potential line, which can be connected to the connection for the reference ground potentially, and a second reference ground potential line which can be connected to the connection for the reference ground potential. A bandgap reference circuit, which can be connected to the first reference ground potential line and can have an output connection. A voltage generator can be connected between the connection for the supply potential and the second reference ground potential line. The second reference ground potential can be connected on the output side to the connection for the output potential to be tapped off, and on the input side, can have a control input for controlling the magnitude of the output potential. A correction circuit which can be connected to the first and second reference ground potential lines, can be coupled on the input side to the bandgap reference circuit, can have an output connection, which can be coupled to the input connection of the voltage generator and can carry a control signal that is dependent upon the potential difference between the first and second reference ground potential lines.

In the generator arrangement according to the invention, the potential difference between the various reference ground potential lines to which the individual stages of the generator arrangement are connected can be compensated for in a correction circuit.

The correction circuit can be connected in the signal path between the bandgap reference circuit and the output-side voltage generator, and can be connected upstream of the output-side voltage generator. The correction circuit can be driven by the impedance converter. The potential difference between the first and second reference ground potential lines can be supplied to the correction circuit. This potential difference can be tapped off at or in the vicinity of the location of the connection of the reference ground potential for the output-side generator and at the location of the connection for the reference ground potential for the impedance converter. The correction circuit can insert a control bias into the control path for driving the output-side voltage generator, such that fluctuations on the second reference ground potential line can be compensated for. The supply voltage, which can be produced across the load that can be connected to the output-side voltage generator can then be produced constantly at the desired magnitude.

According to one embodiment, the correction circuit can superimpose the potential difference, which can be detected between the first and the second reference ground potential line, on the control signal, which can be emitted from the impedance converter, in a linear manner. Overcompensation, equal compensation, or under compensation can be set as a function of the desired requirements, depending on the gain factors in the signal paths. Ideally, the potential difference between the first and second reference ground potential lines can be compensated for. Additive superimposition may be used, for example, for the linear superimposition.

The tap for the potential of the second reference ground potential line to which the output-side voltage generator can be connected can be located closer to that point at which the output-side voltage generator can be connected to this reference ground potential line than to the other end of the reference ground potential line, to which the connecting pad for the external supply of the reference ground potential is connected. Ideally, this tap is located in the immediate vicinity of the contact between the external voltage generator and the second reference ground potential line.

In detail, the correction circuit may be formed from two operational amplifiers, which are connected in series in terms of signal flow. The first operational amplifier can be connected as an adder, and hence the potential difference between the first and the second reference ground potential line to the control potential, which can be produced by the impedance converter. The second, downstream operational amplifier can be connected as an inverter. With suitable resistance values in the external circuitry of the two operational amplifiers, the correction circuit can be designed such that the output voltage from the correction circuit can be the sum of its input voltage and the potential difference between the first and second reference ground potential lines. With regard to the reference ground potential, the correction circuit can be connected to the first reference ground potential line, to which the bandgap reference circuit as well as the impedance converter can also be connected.

The voltage generator has a conventional design. By way of example, the voltage generator includes a comparator to which the control signal that can be produced by the correction circuit can be fed in. On the output side, the comparator can drive a current driving transistor, which can be connected between the output connection and a connection for a supply potential, which, for example, can be supplied externally. The output connection can be connected via a resistive voltage divider to the second reference ground potential line. An output tap on the voltage divider can be fed back to the non-inverting positive input of the comparator.

BRIEF DESCRIPTION OF THE DRAWINGS

The invention will be explained in detail in the following text with reference to the exemplary embodiment, which is illustrated in the drawing. Identical or corresponding elements in the various figures are provided with the same reference symbols. In the figures.

DETAILED DESCRIPTION

Figure 1:
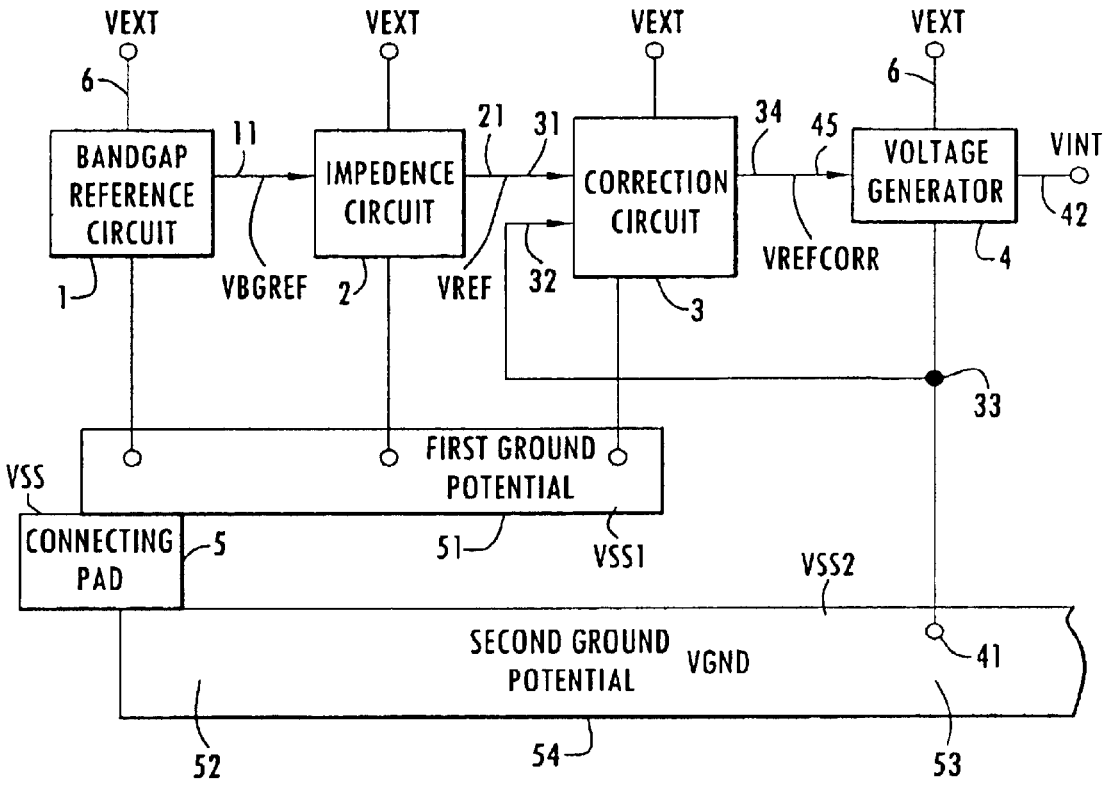
FIG. 1 shows a block diagram of the voltage generator arrangement according to the invention.

Referring to FIG. 1, the voltage generator can use an externally supplied supply voltage VEXT to produce an internal supply voltage VINT, both of which are related to the reference ground potential VSS. The reference ground potential VSS can be, for example, ground. The external supply potential VEXT can be supplied with a low impedance at a connection 6 of the integrated circuit and can be passed to the stages of the voltage generator arrangement. The reference ground potential VSS can be fed in at the connecting pad 5. The connecting pad 5 is a metallization surface in the uppermost metallization layer of the semiconductor chip that is fitted with the voltage generator arrangement. A bonding wire is stamped onto the connecting pad 5, or some other conductor track is pressed onto it, in order to pass the reference ground potential VSS from the exterior to the chip. The reference ground potential VSS is supplied to the functional stages of the illustrated voltage generator arrangement on the one hand via a first reference ground potential line 51 and on the other hand via a second reference ground potential line 54. The first and the second reference ground potential lines 51 and 54, respectively, are conductively connected to one another only via the connecting path 5. The second reference ground potential line 54 can be connected at one end 52 to the connecting pad 5, and has another end 53.

The voltage generator arrangement of FIG. 1 includes a bandgap reference circuit 1, which can be supplied on the supply voltage side from the external supply voltage VEXT, and which can be connected to the first reference ground potential line 51. A bandgap reference circuit based on integrated circuit technology is known. On the output side, this produces a voltage of 1.2 volts, which can be relatively stable and independent of the operating temperature and/or of the applied supply voltage. The output voltage VBGREF at an output connection 11 of the bandgap reference circuit 1 can be produced between the output 11 and the first reference ground potential line 51. The output 11 of the bandgap reference circuit 1 can be connected to an input of an impedance converter 2. In terms of supply voltage, the impedance converter 2 can be connected between the connection 6 for supplying the external supply potential VEXT, and the first reference ground potential line 51. The impedance converter 2 can have an output connection 21, which converts the high-impedance output 11 of the bandgap reference circuit to a low-impedance signal. A reference potential VREF of about 1.6 volts with respect to the reference ground potential VSS can be produced at the output 21.

A correction circuit 3 can be connected in the signal path. On the supply voltage side, the correction circuit 3 can be supplied with the external supply potential VEXT from the connection 6. On the reference ground potential side, the correction circuit 3 can be connected to the first reference ground potential line 51. On the output side, the correction circuit 3 can produce at its output connection 34 a corrected reference voltage VREFCORR, which will be described in more detail below.

Finally, an output-side voltage generator 4 can be provided, which can be fed at the connection 6 from the external supply voltage VEXT, which can be supplied with a low impedance, and can produce an output potential VINT at an output connection 42. On the reference ground potential side, the voltage generator 4 can be connected at a point 41 to the second reference ground potential line 54.

A large number of functional elements, which draw a relatively large current, can be supplied with the voltage VINT, which can be relatively constant, from the output connection 42. The current can flow via the second reference ground potential line 54 back to the connecting path 5 again. The magnitude of the voltage VINT can be relatively set to be as constant by the control signal VREFCORR that can be supplied at the connection 45.

The bandgap reference circuit 1, the impedance converter 2, and the correction circuit 3 can draw a small amount of current, which can be relatively constant, so that only a small constant current can flow via the reference ground potential line 51. The voltage, which can drop along the first reference ground potential line 51, can be regarded as zero. The potential VSS1, which can be produced at points on the reference ground potential line 51, can match the externally supplied potential VSS. Since a dynamic current, which is not negligible and can draw on the load that can be connected to the connection 42, can flow along the second reference ground potential line 54, the voltage drop along the length of the second reference ground potential line 54 can no longer be ignored. The current which, can flow via the load (which is not illustrated), can be provided via the path of the connections 6, 42. The potential VSS2 at the point 41 at which the output-side voltage generator 4 can be connected to the second reference ground potential line 54 can differ by the voltage VGND from the externally supplied reference ground potential VSS. This voltage drop can change with the operating states of the functional unit to be supplied.

The correction circuit 3 also can have an input connection 32, which can supply the potential VSS2 to the correction circuit 3. For this purpose, the input 32 of the correction circuit 3 can be connected at the point 33 to the reference ground potential connection for the output-side voltage generator 4. The connection 33 can be located in the vicinity of the connection 41. Alternatively, the connection can be tapped off directly from the line that connects the connecting point 41 to the voltage generator 4, as is illustrated in FIG. 1. For example, the tap can be formed with a different metallization layer and can be connected at the point 41 by means of a via to that metallization layer or line from which the voltage generator 4 can be supplied. A further line branch can also be arranged directly adjacent to the tap 41 and, for example, runs in the same metallization plane and at an acute angle to the conductor track 54 at the point 53. Since a manual layout can invariably be produced using DRAMs, this configuration of the layout can be made easily. At least the potential VSS2, which can be used for supplying the output-side voltage generator 4 should be present at the input connection 32 of the correction circuit 3. The potential difference VGND thus exists in the correction circuit 3, in order to distinguish between the potentials VSS1, VSS2. The control signal VREFCORR which can be supplied from the correction circuit 3 to the voltage generator 4 can form a superimposition of the potentials VREF and VGND, and VREFCORR=VREF+VGND.

Figure 2:
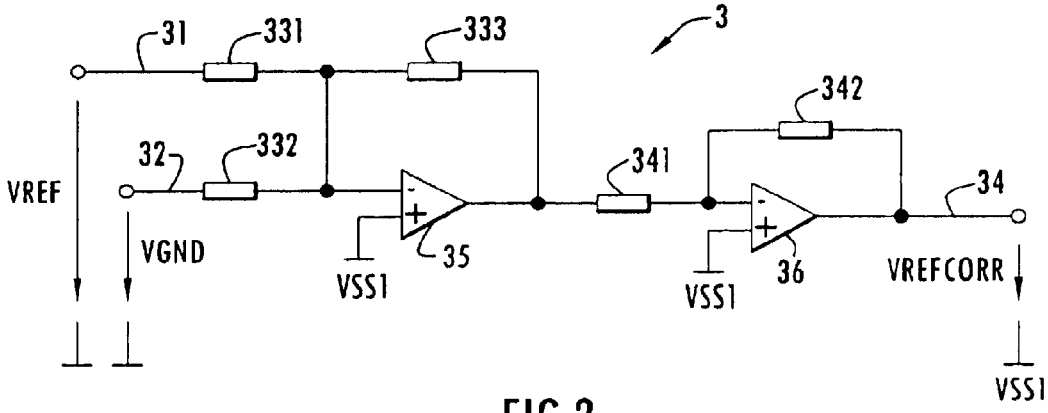
FIG. 2 shows a detailed circuit diagram of one possible embodiment of the correction circuit contained in FIG. 1.

Referring to FIG. 2, the correction circuit 3 from FIG. 1 is illustrated in detail. The correction circuit 3 can have a first operational amplifier 35 and an operational amplifier 36, which can be connected downstream in series. The first operational amplifier 35 can be connected as an adder, and can add the voltages, which can be supplied at the connections 31, 32. In the operational amplifier 35, a non-inverting positive input can be connected to the potential VSS1 on the first reference ground potential line 51. The inverting negative input can be connected via a resistor 331 to the connection 31, which can carry the reference potential VREF from the impedance converter. The negative input of the operational amplifier 35 can also be connected via a resistor 332 to the connection 32, which can be connected to the reference ground potential connection 41 of the voltage generator 4. The connection 32 is thus at the potential VGND, i.e., the potential difference between the potentials VSS2, VSS. Finally, the negative input of the operational amplifier 35 can be connected via a resistor 333 to its output.

The operational amplifier 36 can be connected as an inverter. Its positive input can be at the potential VSS1. Its negative input can be connected via a resistor 341 to the output of the inverter 33, and can be coupled via a resistor 342 to the output 34, which can be at the corrected reference potential VREFCORR. If the resistors 331, 332 can be of equal magnitude, the correction potential VREFCORR can be calculated using the following formula:

$$VREFCORR=(VREF+VGND)*(R331*R341)/(R333*R342)$$

In this case, R331 is the resistance value of the resistor 331 etc. Depending on the values of the resistors, direct compensation can be achieved for the voltage offset VGND along the line 54 in the correction control signal VREFCORR, or else overcompensation or undercompensation. Direct compensation can be achieved when:

$$R331*R341=R333*R342.$$

The second reference ground potential line 54 can have a first end 52, which can be connected directly to the connecting pad 5, and a second end 53 which can be connected to the connecting point 41 at which the reference ground potential VSS2 can be tapped off at the voltage generator 4. In principle, the input connection 32 should be coupled as closely as possible to the connection 41 to the reference ground potential line 54. At the least, the connection 32 should be located closer to the end 53 along the line 54 than to the end 52. If the tap 33 is not located directly at the point 41 but is shifted in the direction of the end 52 of the line 54, a higher compensation factor can be set by using suitable values for the resistors mentioned above.

Figure 3:
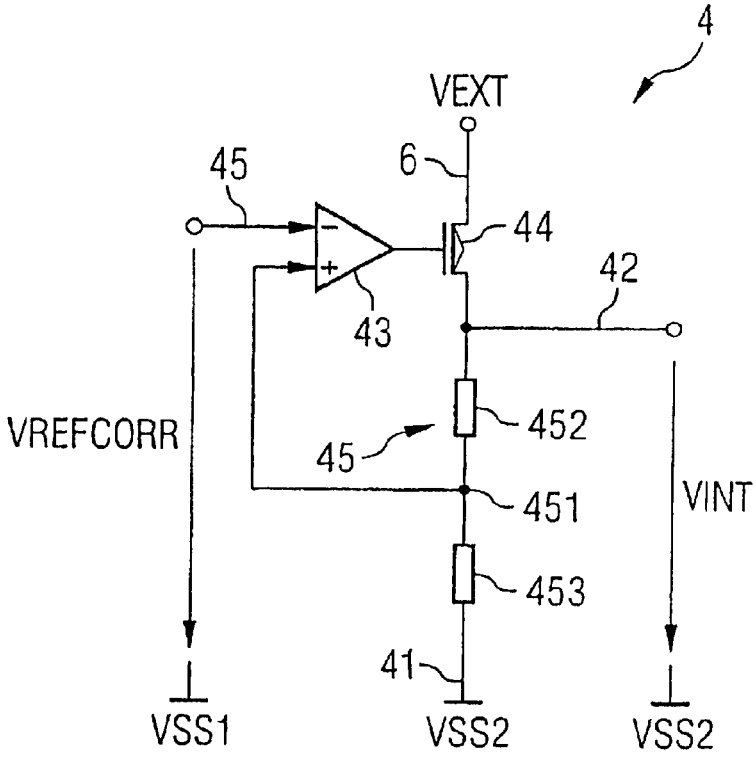
FIG. 3 shows a detailed circuit diagram of the output-side voltage generator that is contained in FIG. 1.

FIG. 3 shows one implementation of the output-side voltage generator 4. A comparator 43 can be supplied at the negative input 45 with the corrected reference potential VREFCORR. One output of the comparator 43 can drive the gate connection of a load transistor 44. The transistor 44 can be a P-channel MOS transistor. The source connection of the transistor 44 can be connected to the connection 6 for supplying the external supply potential VEXT. The drain connection of the transistor 44 is connected to the output connection 42, at which the output voltage VINT, which can be referenced to the potential VSS2, can be tapped off in order to supply a load (which is not illustrated). The drain connection of the transistor 44, or the output connection 42, can be connected via a voltage divider to the connection 41 for the reference ground potential VSS2. The voltage divider can be formed from resistors 452, 453 connected in series. The coupling node 451 between the resistors 452, 453 can be fed back to the positive input of the operational amplifier 43.

The details of one or more embodiments are set forth in the accompanying drawings and the description below. Other features will be apparent from the description and drawings and from the claims.

List of Reference Symbols

1 Bandgap reference circuit
2 Impedance converter
3 Correction circuit
4 Voltage generator
5 Connecting pad
6 Connection for the external supply potential
11,21,34,42 Output connections
31, 32, 45 Input connections
35, 36 Operational amplifier
41 Connecting point
43 Comparator
44 Load transistor
451 Tap
551 First reference ground potential line
52 Second reference ground potential line
52, 53 Ends of the second reference ground potential line
452, 453 Resistors for a voltage divider
331,332,333,341,342 Resistors
VEXT External supply potential
VSS Reference ground potential, ground
VSS1, VSS2 Reference ground potential
VGND Reference ground potential difference
VBGREF Bandgap reference potential
VREF Reference signal
VREFCORR Corrector reference signal
VINT Output potential

What is claimed is:

1. A voltage generator arrangement, comprising:

a first connection for a supply potential;

a second connection for a reference ground potential; and a first output connection for an output potential to be tapped off;

a first reference ground potential line, the first reference ground potential line being connected to the second connection;

a second reference ground potential line, the second reference ground potential line being connected to the second connection;

a bandgap reference circuit, the bandgap reference circuit being connected to the first reference ground potential line having a second output connection;

a voltage generator, the voltage generator being connected between the first connection and the second reference ground potential line, the second reference ground line being connected on the output side to the first output connection to be tapped off, on the input side, having a control input for controlling the magnitude of the output potential; and a correction circuit, the correction circuit being connected to the first and second reference ground potential lines, being coupled on the input side to the bandgap reference circuit, and having a third output connection, the third output connection being coupled to the input of the voltage generator and carrying a control signal, the control signal being dependent upon the potential difference between the first and second reference ground potential lines.

2. The voltage generator arrangement as claimed in claim 1, further comprising:

an impedance converter circuit, the impedance converter circuit being connected to the first reference ground potential line and having an input/output signal path connected between the output of the bandgap reference circuit and an input of the correction circuit.

3. The voltage generator arrangement as claimed in claim 1, wherein the correction circuit has a linearly superimposing circuit to linearly superimpose a signal which is dependent on the potential difference between the potentials of the first and second reference ground potential lines on a signal which is produced by the bandgap reference circuit.

4. The voltage generator arrangement as claimed in claim 3, wherein the bandgap reference circuit, the impedance converter circuit and the correction circuit are connected on the supply voltage side to the first connection for the supply potential.

5. The voltage generator arrangement as claimed in claim 1, wherein the second reference ground potential line is a longitudinally extending line which is connected at a first end to the connection for the external supply of the reference ground potential, and which is connected at a second end to the voltage generator, and wherein the correction circuit contacts the second reference ground potential line closer to the second end than to the first end.

6. The voltage generator arrangement as claimed in claim 5, wherein the correction circuit contacts the second reference ground potential line proximate to a point at which the voltage generator is connected to the second reference ground potential line.

7. The voltage generator arrangement as claimed in claim 1, wherein the correction circuit has a first operational amplifier, which is connected as an inverting adder and which is coupled on the input side to the bandgap reference circuit and to the second reference ground potential line.

8. The voltage generator arrangement as claimed in claim 7, wherein the correction circuit has a second operational amplifier, which is connected as an inverting amplifier and is coupled on the input side to an output of the first operational amplifier.

9. The voltage generator arrangement as claimed in claim 1, wherein the voltage generator includes a comparator, which is connected on the output side to the control input of a load transistor, wherein the load transistor is connected between the connection for the supply potential and the output connection for the output potential to be tapped off, and wherein a voltage divider is provided, is connected between this output connection and the second reference ground potential line, and has a tap which is fed back to an input of the comparator.

10. The voltage generator arrangement as claimed in claim 2, wherein the correction circuit has a linearly superimposing circuit to linearly superimpose a signal which is dependent on the potential difference between the potentials of the first and second reference ground potential lines on a signal which is produced by the bandgap reference circuit.

11. The voltage generator arrangement as claimed in claim 10, wherein the bandgap reference circuit, the impedance converter circuit and the correction circuit are connected on the supply voltage side to the first connection for the supply potential.

* * * * *